US005183620A

United States Patent [19]

Duncan et al.

[11] Patent Number: 5,183,620

[45] Date of Patent: Feb. 2, 1993

[54] PROCESS OF DRAWING YARN USING AN OSCILLATING DRAW ASSIST ELEMENT

[75] Inventors: James E. Duncan; Dean H. Smiley, both of Richmond, Va.

[73] Assignee: E. I. Du Pont de Nemours and Company, Wilmington, Del.

[21] Appl. No.: 635,917

[22] Filed: Dec. 28, 1990

Related U.S. Application Data

[63] Continuation-in-part of Ser. No. 561,035, Aug. 1, 1990, abandoned.

[51] Int. Cl.[5] ..... D02J 1/22

[52] U.S. Cl. ..... 264/290.7; 264/210.8; 264/DIG. 73

[58] Field of Search ..... 264/210.8, 290.5, 290.7, 264/DIG. 73

[56] References Cited

U.S. PATENT DOCUMENTS

| | | | |
|---|---|---|---|
| 3,311,691 | 3/1967 | Good | 264/290.7 |
| 3,416,742 | 12/1968 | Haninger | 242/47.09 |
| 3,441,642 | 4/1969 | Engelman et al. | 264/290.7 |
| 3,561,045 | 2/1971 | Heffernan | 264/290.7 |
| 4,880,961 | 11/1989 | Duncan | 219/388 |

FOREIGN PATENT DOCUMENTS

| | | | |
|---|---|---|---|
| 0907754 | 10/1962 | United Kingdom | 264/290.7 |
| 1215143 | 12/1970 | United Kingdom | 264/290.7 |

*Primary Examiner*—James Lowe

[57] ABSTRACT

A process and apparatus for drawing polyamide yarn in which the yarn having a lubricating finish is drawn while being spirally advanced in frictional contact with the outer surface of a yarn draw assist element. In such process and apparatus, the outer surface of the draw assist element moves at a speed at least 100 times slower than the speed at which the yarn is advanced. From the draw assist element, the yarn directly advances to a roll initial contact location on a pair of space-apart heated rolls and spirally advances on the rolls through at least one wrap in contact with the outwardly-facing surfaces of the heated rolls. The distance that the yarn spirally advances longitudinally in the wrap can be said to define the wrap advance on the rolls. The roll initial contact location of the heated rolls is oscillated by moving the outer surface of the draw assist element in relation to the pair of heated rolls to oscillate the wrap on the rolls a distance which is at least equal to the wrap advance. The process and apparatus advantageously prevent the build-up of deposits on the heated rolls.

9 Claims, 5 Drawing Sheets

PROCESS OF DRAWING YARN USING AN OSCILLATING DRAW ASSIST ELEMENT

BACKGROUND OF THE INVENTION

This is a continuation-in-part of application Ser. No. 07/561,035 filed Aug. 1, 1990 and now abandoned.

The present invention relates to the drawing of polyamide yarns and more particularly relates to a process and apparatus useful for drawing polyamide yarns which employs a draw assist element to provide oscillating movement to yarn.

In the production of polyamide yarn using the two stage draw process described in U.S. Pat. No. 3,311,691 (Good), the yarn in the second stage is spirally advanced in frictional contact with a draw assist element by second stage draw rolls which are heated in an enclosure often referred to as an "annealing chest". When the annealing chest temperature is equal to or greater than 150° C., the organic yarn lubricant or other organic finish components employed in the "spin finish" often degrade on the second stage draw rolls. As the finish degrades, it tends to form deposits and, unless removed, the deposits harden into jagged "hills" at the edges of the yarn path which have the appearance of tracks on the rolls. If these hardened deposits are not periodically removed mechanically which requires shutting down the process, the deposits ultimately result in poor spinning performance and yarn mechanical quality defects.

To alleviate this problem, it has been attempted to use an oscillating ceramic or chrome plated steel pin between the draw assist element and the draw rolls in the annealing chest to contact the yarn and oscillate it on the second stage draw rolls so that the "hills" do not form. However, degraded finish builds up on the oscillating pin again leading to mechanical defects in the yarn.

SUMMARY OF THE INVENTION

The invention relates to an improved process and apparatus for drawing polyamide yarn in which the yarn having a lubricating finish is drawn while being spirally advanced in frictional contact with the outer surface of a yarn draw assist element. In such process and apparatus, the outer surface of the draw assist element moves at a speed at least 100 times slower than the speed at which the yarn is advanced. From the yarn draw assist element, the yarn directly advances to a roll initial contact location on a pair of spaced-apart heated rolls and spirally advances on the rolls through at least one wrap in contact with the outwardly-facing surfaces of the heated rolls. The distance that the yarn spirally advances longitudinally in the wrap can be said to define the wrap advance on the rolls. In accordance with the invention, the roll initial contact location on the heated rolls is oscillated by moving the outer surface of the yarn draw assist element in relation to the pair of heated rolls to oscillate the wrap on the rolls a distance which is at least equal to the wrap advance.

In accordance with a preferred form of the present invention, the yarn advances through a plurality of spaced-apart wraps on the spaced-apart heated rolls with each of the wraps having essentially the same wrap advance and the oscillating of the roll initial contact location by moving the outer surface of the yarn draw assist element causes each of the wraps to oscillate a distance which is at least equal to its wrap advance.

In accordance with one preferred embodiment of the present invention, the draw assist element has a cylindrical outer surface and the oscillating of the roll initial contact location is performed by oscillating the yarn draw assist element transversely with respect to the heated rolls. Preferably, the oscillating of the cylindrical yarn draw assist element transversely is performed by oscillating the element by pivoting the element about a pivot axis.

In accordance with another preferred embodiment of the invention particularly suited to draw assist elements heated by a hot fluid, the draw assist element comprises a cylindrical tube supported for rotation on mounting means. The mounting means provides an axis of rotation for the cylindrical tube which is sufficiently different from the centerline axis of the cylindrical tube that the cylindrical tube moves eccentrically to oscillate the wrap on the rolls a distance which is at least equal to the wrap advance.

The invention provides a process and an apparatus for drawing polyamide yarns which prevents the build-up of "hills" of finish deposits beside the yarn path on heated rolls following a draw assist element. The mechanical quality of the yarn can thereby be improved and the number of process shutdowns necessary for equipment maintenance can be decreased. The invention is well-suited to commercial processes for the drawing of polyamides and existing equipment can be easily modified for practice of the invention.

BRIEF DESCRIPTION OF THE DRAWINGS

The invention and its advantages are best understood from the following detailed description of a preferred embodiment when read in conjunction with the accompanying drawings in which.

DETAILED DESCRIPTION

Figure 1:
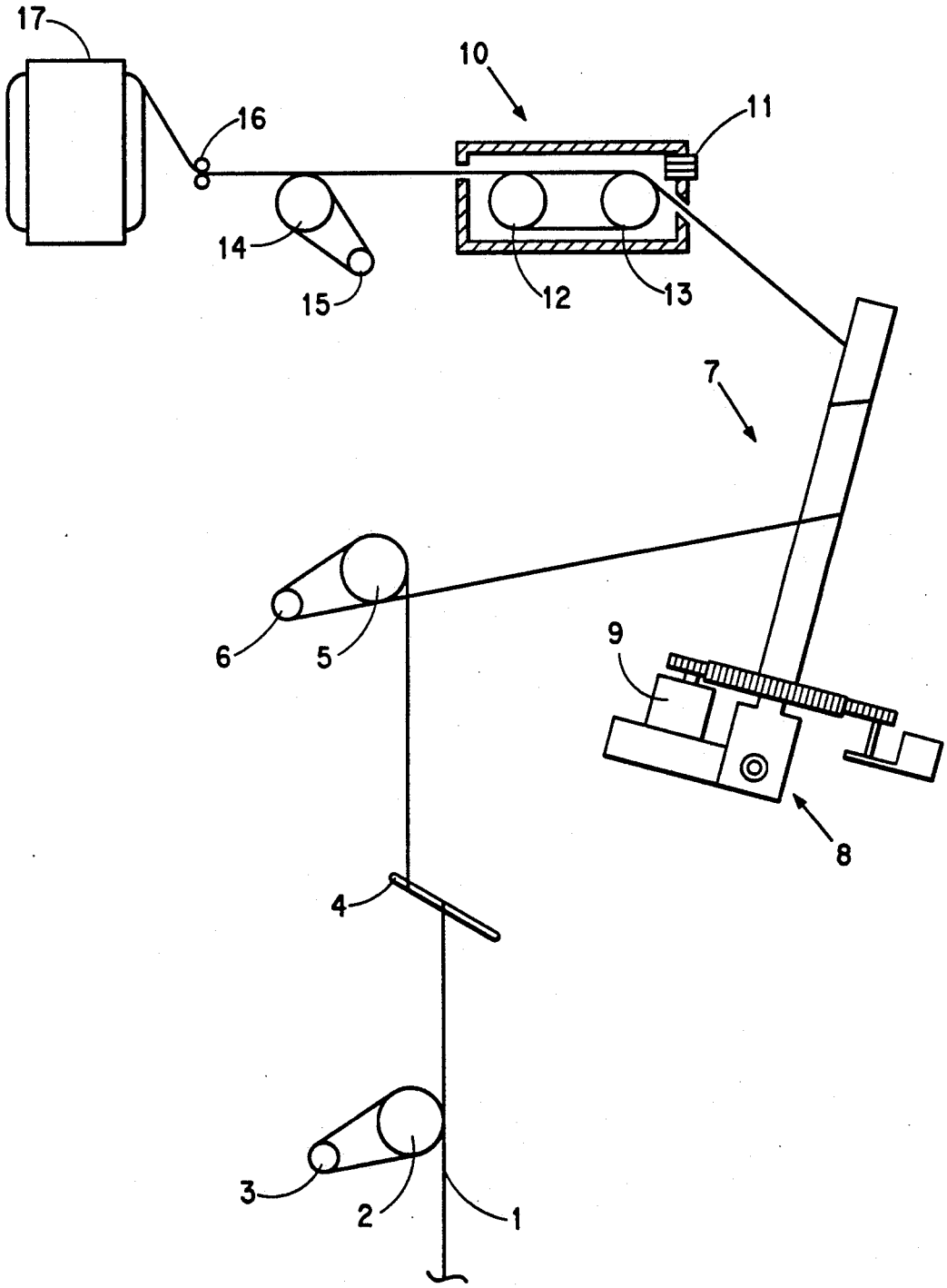
FIG. 1 is schematic illustration of a two stage process for drawing polyamides incorporating one preferred embodiment of a draw assist element in accordance with the present invention.

Referring to the drawings in which like reference characters designate like or corresponding parts throughout the several views, the process chosen for purposes of illustration is a two stage drawing process of the type disclosed in U.S. Pat. Nos. 3,311,691 and 4,880,961. U.S. Pat. Nos. 3,311,691 and 4,880,961 are hereby incorporated by reference. Referring to FIG. 1, a polyamide yarn 1 containing a lubricating finish (finish application not shown) is advanced in the first draw stage by a driven roll 2 and associated separator roll 3 which provide feed roll means for the yarn 1. Driven roll 5 and associated separator roll 6 form draw roll means for the first drawing stage as well as the feed roll for the second stage. A snubbing pin 4, conveniently made of an abrasion resistant material such as aluminum oxide, sapphire, chromium plate or the like, is provided as a frictional element in the first draw zone to localize the draw point. The amount of draw imparted in the first draw stage can be, for example, between about 2.2 to about 5.0X.

Figure 2:
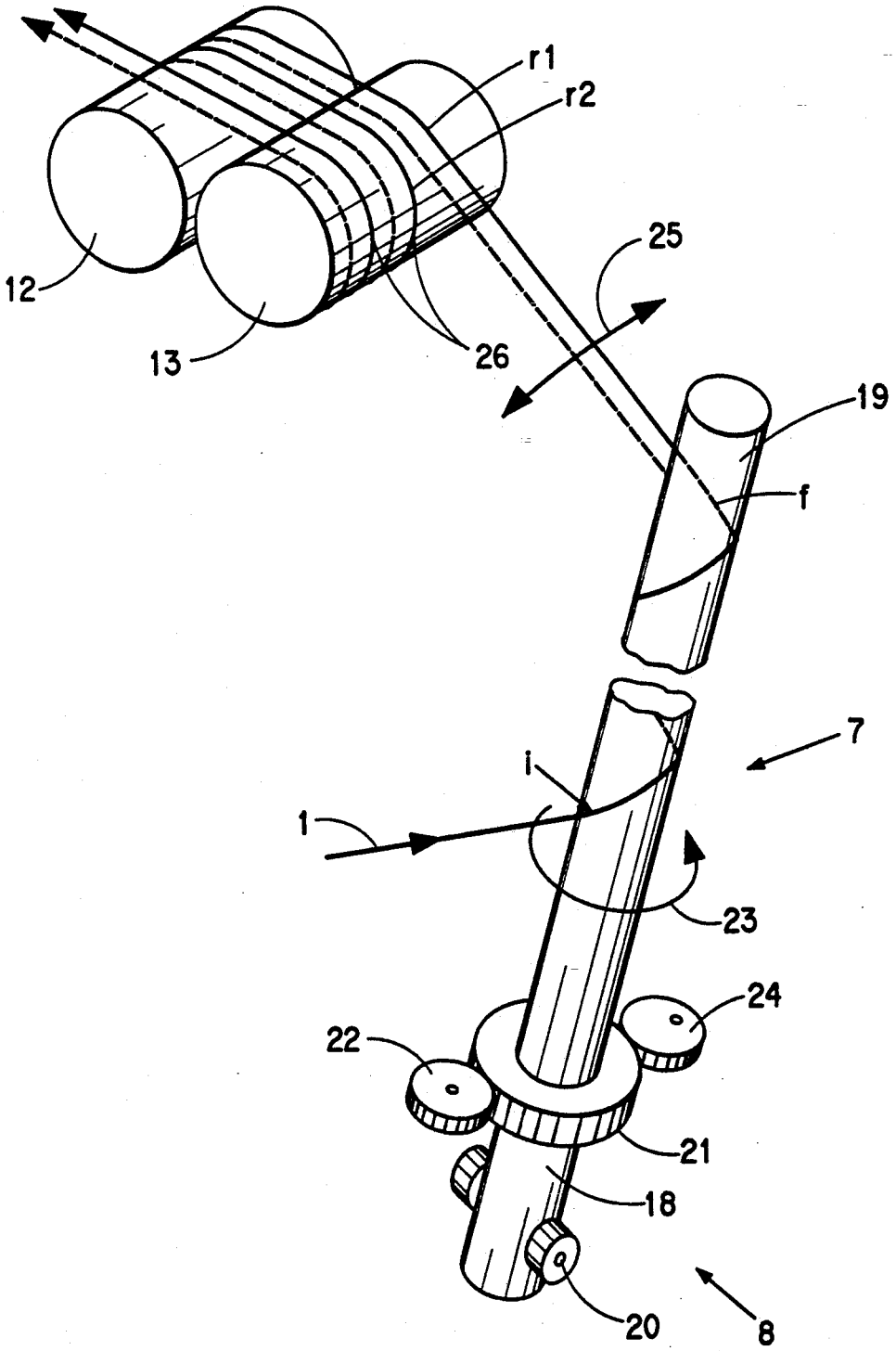
FIG. 2 is an enlarged schematic, perspective view of the preferred draw assist element as in FIG. 1 showing a preferred orientation relative to second stage draw rolls.

The yarn 1 enters the second draw stage from the rolls 5 and 6 and spirally advances in frictional contact with a draw assist element 7 on which most of the draw of the second draw stage occurs. Preferably, the yarn travels on the draw-assist element in an extended spiral path with between about 1½ and 3½ wraps about a major portion of the element (e.g., over a length of about ⅔ meter). In the preferred draw assist element depicted in FIGS. 1 and 2, element 7 is cylindrical and has a wear-resistant cylindrical surface such as that which can be provided by chromium plated steel. The draw assist element 7 also preferably tubular so that heating means can be provided in its interior. While any of a variety of heating means can be employed such as circulating a heat transfer medium in the tube's interior, heating capability for the embodiment depicted in FIGS. 1 and 2 is preferably provided by a core heating element spaced-apart from the tube which is provided with an electric resistance heating element. A draw assist element of the type disclosed in U.S. Pat. No. 4,880,961 is most preferably employed in the practice of this embodiment of the present invention.

As will be described in more detail hereinafter, draw assist element 7 includes a mounting means 8 which provides rotation using motor 9 at a low rate of speed so that the spirally advancing yarn will not contact the same area of the element and thus wear will occur uniformly over the element's surface. The rate of rotation is such that the speed of movement of the surface of the element 7 in relation to the yarn speed is at least about 100 or more times slower so that the frictional contact with the element 7 is substantially the same as if the element was fixed. In most processes, the surface speed will be substantially more than 100 times less than the yarn speed. A suitable rate of rotation is, for example for an 8 cm diameter draw assist element, about one revolution every 5–15 minutes for yarn entrance speeds of about 800 to about 3000 meters per minute (mpm) and yarn exit speeds of about 1600 to about 3500 mpm.

Referring again to FIG. 1, from the draw assist element 7 the yarn directly advances to driven rolls 12 and 13 which serve as the second stage draw rolls. The speed of rotation of these rolls is such that the draw imparted to the yarn is typically at least about 1.1X. In addition, the rolls 12 and 13 are heated and are used to maintain at least one wrap of the yarn on the rolls at substantially constant length in a heated condition. At high yarn speeds, a suitable heating time at constant length is achieved by having the yarn advance about the rolls in a plurality of wraps. A preferred heating system for the rolls 12 and 13 is to employ an annealing chest 10 which is an insulated enclosure which is supplied with hot air through duct 11.

After the yarn leaves the annealing chest, driven roll 14 and associated separator roll 15 serve as a tension let down system and operate at a lower peripheral speed than rolls 12 and 13. A yarn guide 16 is associated with a conventional wind-up 17. A conventional yarn traversing mechanism (not shown) is also employed to form suitable yarn packages.

Referring now with more particularity to FIG. 2, one preferred draw assist element 7 is shown in relation to the rolls 12 and 13. (The annealing chest 10 is not shown in FIG. 2.) The mounting means 8 of the draw assist element 7 includes a base 18 which, in this embodiment, provides a pivot axis 20 which is in a plane perpendicular to the axes of the rolls 12 and 13 and allows the draw assist element 7 to be pivoted at this axis as will be described in more detail hereinafter. In order for the surface of the draw assist element 7 to rotate in relation to the base 18, the surface of the element is provided by a cylindrical tube 19 which is rotatably supported on the base 18 by suitable means such as bearings (not shown). The tube 19 includes a ring gear 21 fastened to the tube 19 at its lower end and a drive pinion 22, operatively connected to motor 9 (not shown in FIG. 2), which rotates the sleeve of the draw assist element 7 at speeds as have been described previously in the direction indicated by arrow 23. A suitable motor and associated gear box is a model Flex-o-Action by Merkle-Koroff, Chicago, Ill., which can be attached to base 18.

The mounting means 8 for the draw assist element 7 illustrated includes an eccentric idler pinion 24 mounted on a fixed support (not shown in FIG. 2) opposite the drive pinion 22 so that the eccentric idler pinion 24 also engages the ring gear 21. The eccentric pinion 24 is positioned so that the draw assist element 7 is inclined at a sufficient angle that it rests against the eccentric pinion 24 and remains stable under its own weight in this position while being free to pivot on its pivot axis 20. A suitable angle of incline is about 10–15 degrees from vertical. As the ring gear 21 is driven by pinion 22, eccentric pinion 24 is correspondingly driven by the ring gear 21. Due to the eccentricity of pinion 24, the angle of the draw assist element 7 is caused to change periodically and provides an oscillating movement in the directions indicated by double-headed arrow 25.

Referring still to FIG. 2, the yarn is shown to contact the draw assist element 7 first at a yarn initial contact location identified by the reference character "i" and the yarn leaves the draw assist element at a yarn final contact location "f" and advances directly to the rolls 12 and 13. The roll initial contact location where the yarn initially contacts the rolls is on roll 13 and is identified as "r1". The yarn initial and final contact locations are not affected by the rotation per se of the cylindrical draw assist element 7 in the preferred embodiment depicted in FIGS. 1 and 2 although there is no intent to limit the invention in this regard. In any event, the yarn final contact location "f" on the surface of the draw assist element 7 is oscillated by the movement of the draw assist element 7 which oscillates the location "r1" where the yarn first contacts the roll 13. In this embodiment, the oscillation of the draw assist element 7 on its axis 20 by operation of the eccentric idler pinion 24 transversely oscillates the final contact location "f" in relation to rolls 12 and 13 which in turn oscillates the roll initial contact location "r1."

Figure 3:
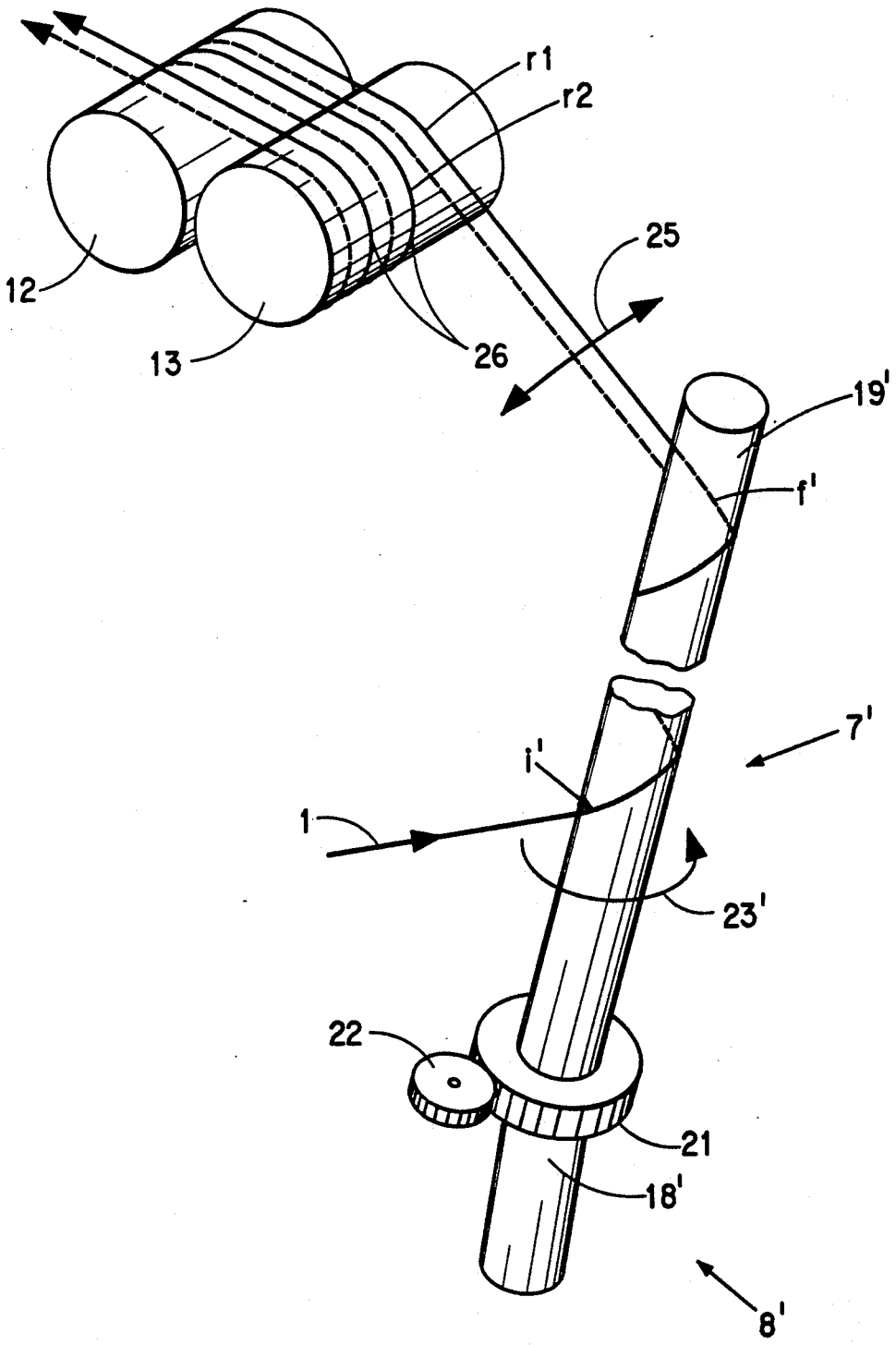
FIG. 3 is an enlarged schematic, perspective view of another preferred draw assist element.
Figure 4:
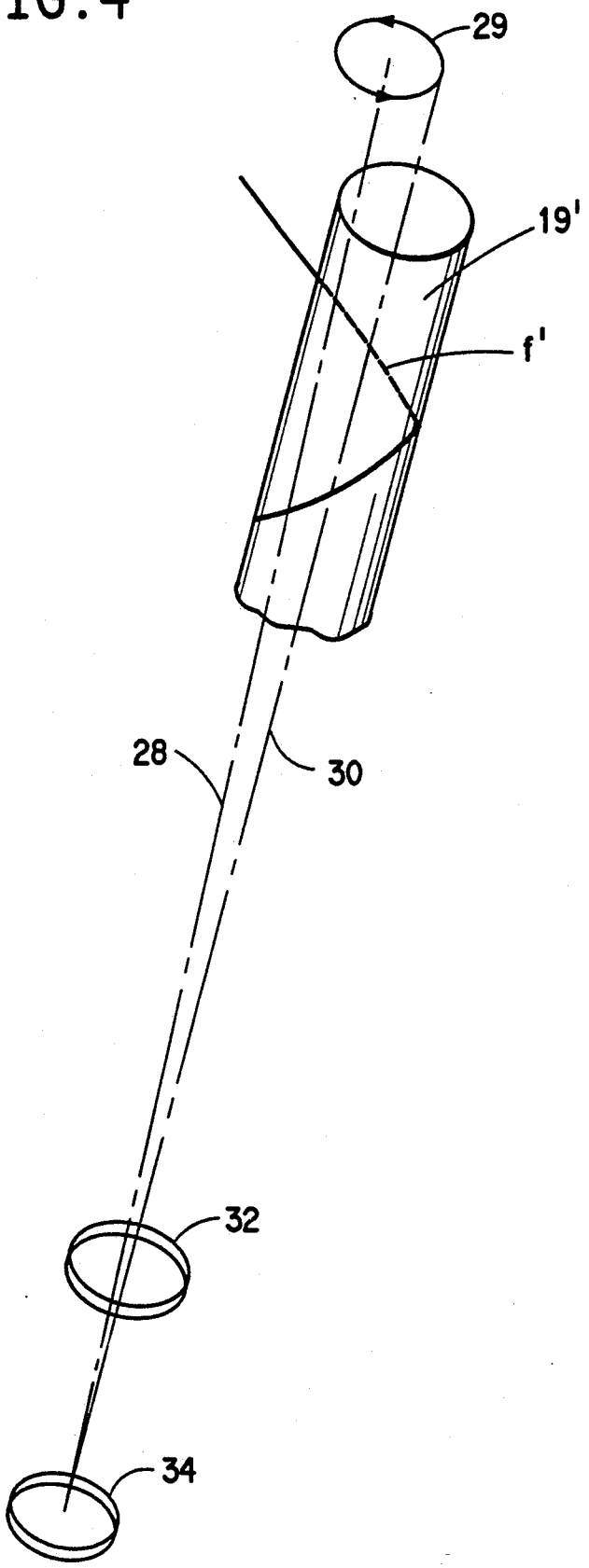
FIG. 4 is an enlarged schematic, perspective view of the upper end of the draw assist element of FIG. 3.

Another preferred embodiment of the invention is depicted in FIGS. 3 and 4. In this embodiment, a draw assist element 7' includes a mounting means 8' used for supporting a cylindrical tube 19' similar to the cylindrical tube 19 for draw assist element 7. The mounting means 8' employs same motor 9, pinion 22 and ring gear 21 as in embodiment described in FIGS. 1 and 2. However, as illustrated most clearly in FIG. 4 in broken lines, the mounting means 8' has an axis of rotation 28 which is different from the centerline axis 30 of the cylindrical tube 19'.

As illustrated schematically in FIG. 4, this is advantageously accomplished by employing circular upper and lower bearings 32 and 34, respectively, at least one of which is aligned off center with respect to the centerline axis 30 of the cylindrical tube 19'. The degree of alignment difference provided is such that the cylindrical tube 19' at the final yarn contact "f'" location moves to oscillate the initial roll contact location "r1" as the tube 19' is rotated. The eccentric movement of the tube 19' is shown by the circle 29 which is the path of the centerline axis 30 of the tube 19' at this position. As illustrated in FIG. 4 for the preferred embodiment, the center of the upper bearing 32 is off center with respect to the centerline axis 30. This can be accomplished, for example, by using a cam grinder to grind a bearing journal for bearing 32 (and any surfaces needed for fluid seals) off center after assembly of the tube 19'. Another means of accomplishing the same result is to bend the cylindrical tube close to the mounting means so that its upper portion has a centerline axis which is different from its axis of rotation.

The embodiment of the invention using the draw assist element 7' is especially useful when a heated fluid such as hot oil is circulated into cylindrical tube for heating since no hoses or other flexible piping are necessary. Provided that the length of the cylindrical tube 19' is sufficient to obtain the desired degree of movement at the final yarn contact location "f'" with a small degree of movement at ring gear 21, a simple drive pinion 22 is suitable for rotation.

Figure 5:
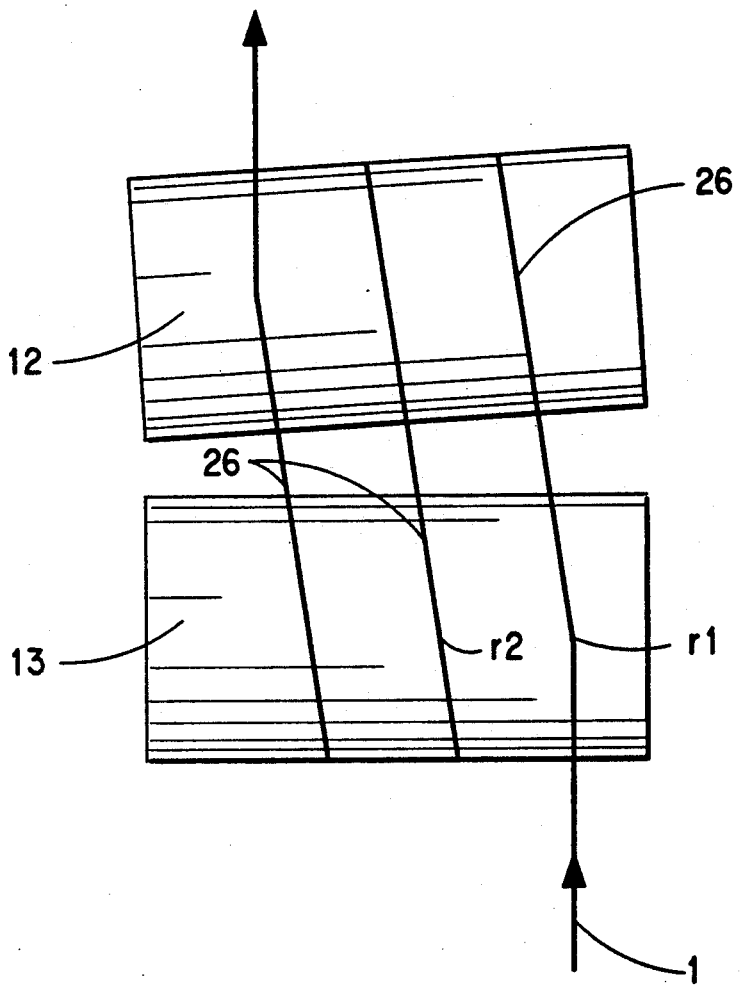
FIG. 5 is an enlarged plan view of the second stage draw rolls of FIGS. 2 or 3.

Referring now to the plan view of rolls 12 and 13 in FIG. 5, it is shown that roll 12 is canted at a slight angle in relation to roll 13 to cause the yarn to advance along the rolls. The longitudinal distance (along the roll surface parallel to the roll axis) between adjacent wraps is typically referred to as the "wrap advance". The "wrap advance" can be determined by measuring the longitudinal distance between the roll initial contact location "rl" and the corresponding downstream contact location along the surface of the roll 13 after one complete wrap. In FIGS. 2 and 3, this location is identified as "r2".

Referring either to FIGS. 2 and 5 or to FIGS. 3, 4 and 5, as the yarn 1 advances from the final contact location "f" or "f'" of the draw assist element 7 or 7' onto the heated rolls 12 and 13, it is moved transversely as it advances to oscillate the roll initial contact location "rl". The movement of the surface of the draw assist element 7 or 7' relative to the rolls 12 and 13 is of sufficient magnitude that the roll initial contact location "r1" oscillates a distance which is at least equal to the wrap advance. For example, if "r1" as depicted is the farthest position to the right in an oscillation, this location will oscillate at least as far as the location now identified as "r2". This oscillation causes all of the wraps 26 on the rolls 12 and 13 to oscillate a distance which is at least equal to their wrap advance. FIGS. 2 and 3 illustrate in broken lines the position of the yarn on the rolls 12 and 13 when about half an oscillation has been completed.

To illustrate the use of the one embodiment of the draw assist element 7 having overall length of about one meter, a diameter of about 8 cm, and where the ring gear is about 10 percent of this length up from the pivot axis 20, an eccentricity of about 0.85 mm for the eccentric idler pinion 24 is sufficient to suitably oscillate the roll initial contact location in accordance with the invention when the wrap advance is about 0.79 cm.

In operation, yarn 1 from a source not shown is forwarded by feed rolls, 2 and 3, and passes around snubbing pin 4. First stage draw rolls 5 and 6 are operated at a surface speed higher than that of feed rolls 2 and 3, whereby the yarn is drawn to a specified extent in the first stage while snubbed around pin 4. Yarn leaving roll system 5, 6 passes about the draw assist element 7 or 7', whereby the yarn is raised in temperature and is subjected to drawing tension provided by rolls 12 and 13. An additional amount of drawing thereby takes place in the second draw stage.

The yarn proceeds directly from the final contact location "f" or "f'" of draw assist element 7 or 7' and forms a number of wraps about rolls 12 and 13 whereby it is held at elevated temperature and constant length for the time specified. As the yarn is advanced from the draw assist element 7 or 7', it is oscillated by the movement of the surface of the draw assist element 7 or 7' relative to the rolls 12 and 13 so that the yarn wraps on rolls 12 and 13 oscillate a distance which is at least equal to the wrap advance. This causes substantially the entire surfaces of the heated rolls 12 and 13 to be contacted by the yarn in the process except for areas adjacent the roll ends. Thus, in the process in accordance with the invention, there are no yarn "tracks" along which deposits can build up.

From rolls 12 and 13, the yarn proceeds to rolls 14 and 15 at a lower peripheral speed than rolls 12 and 13, thus permitting the yarn to relax a predetermined amount. Since rolls 14 and 15 are unheated (except by contact with the hot yarn), the yarn is cooled by contact therewith, largely preventing further retraction in subsequent handling steps. Yarn, leaving rolls 14 and 15, is packaged on a wind-up such as the surface-driven, no twist wind-up indicated at 17.

While preferred embodiments have been shown and described in the foregoing detailed description, it will be understood that the invention is capable of numerous modifications, rearrangements and substitution of parts without departing from the spirit of the invention as set forth in the appended claims.

We claim:

1. In a process in which polyamide yarn having a lubricating finish is drawn while being spirally advanced in frictional contact with the outer surface of a yarn draw assist element, said outer surface of said draw assist element moving at a speed at least 100 times slower than the speed at which the yarn is advanced, and said yarn directly advancing from said yarn draw assist element to a roll initial contact location on a pair of spaced-apart heated rolls and spirally advancing on said rolls through at least one wrap in contact with the outwardly-facing surfaces of said heated rolls, the distance that the yarn spirally advances longitudinally in said wrap defining the wrap advance on said rolls, the improvement comprising oscillating said roll initial contact location of said rolls by moving said outer surface of said draw assist element in relation to said pair of heated rolls to oscillate said wrap on said rolls a distance which is at least equal to said wrap advance.

2. The process of claim 1 wherein said yarn advances through a plurality of spaced-apart wraps on said spaced-apart heated rolls with each of said wraps having essentially the same wrap advance, and said oscillating of said roll initial contact location by moving the surface of said draw assist element causing each of said wraps to oscillate a distance which is at least equal to its wrap advance.

3. The process of claim 1 wherein said draw assist element has a cylindrical outer surface and said oscillating of said roll initial contact location is performed by oscillating said yarn draw assist element transversely with respect to said heated rolls.

4. In a process in which polyamide yarn having a lubricating finish is drawn while being spirally advanced in frictional contact with the outer surface of a yarn draw assist element, said outer surface of said draw assist element moving at a speed at least 100 times slower than the speed at which the yarn is advanced, and said yarn directly advancing from said yarn draw assist element to a roll initial contact location on a pair of spaced-apart heated rolls and spirally advancing on said rolls through at least one wrap in contact with the outwardly-facing surfaces of said heated rolls, the distance that the yarn spirally advances longitudinally in said wrap defining the wrap advance on said rolls, the improvement comprising oscillating said roll initial contact location of said rolls by moving said outer surface of said draw assist element in relation to said pair of heated rolls to oscillate said wrap on said rolls a distance which is at least equal to said wrap advance, said draw assist element having a cylindrical outer surface and said oscillating of said roll initial contact location being performed by oscillating said yarn draw assist element transversely with respect to said heated rolls, said oscillating of said cylindrical yarn draw assist element transversely being performed by oscillating said element by pivoting said element about a pivot axis.

5. The process of claim 4 wherein said pivot axis is generally perpendicular to the axes of said heated rolls.

6. The process of claim 5 further comprising heating said cylindrical yarn draw assist element.

7. In a process in which polyamide yarn having a lubricating finish is drawn while being spirally advanced in frictional contact with the outer surface of a yarn draw assist element, said outer surface of said draw assist element moving at a speed at least 100 times slower than the speed at which the yarn is advanced, and said yarn directly advancing from said yarn draw assist element to a roll initial contact location on a pair of spaced-apart heated rolls and spirally advancing on said rolls through at least one wrap in contact with the outwardly-facing surfaces of said heated rolls, the distance that the yarn spirally advances longitudinally in said wrap defining the wrap advance on said rolls, the improvement comprising oscillating said roll initial contact location of said rolls by moving said outer surface of said draw assist element in relation to said pair of heated rolls to oscillate said wrap on said rolls a distance which is at least equal to said wrap advance, said draw assist element comprising a cylindrical tube supported for rotation on mounting means, said mounting means providing an axis of rotation for said cylindrical tube which is sufficiently different from the centerline axis of said cylindrical tube that said cylindrical tube moves eccentrically to oscillate said wrap on said rolls a distance which is at least equal to said wrap advance.

8. The process of claim 7 wherein said mounting means comprises at least two spaced-apart bearings for supporting said cylindrical tube for rotation, at least one of said bearings being positioned off center with respect to said centerline axis of said cylindrical tube.

9. The process of claim 7 wherein said draw assist element is heated by the circulation of a hot fluid into the interior of said cylindrical tube.

* * * * *